US005433447A

United States Patent [19]

Pocklington

[11] Patent Number: 5,433,447

[45] Date of Patent: Jul. 18, 1995

[54] GOLF BALL

[75] Inventor: Terence W. Pocklington, Tupelo, Miss.

[73] Assignee: Hansberger Precision Golf Incorporated, Pontotoc, Miss.

[21] Appl. No.: 218,056

[22] Filed: Mar. 25, 1994

[51] Int. Cl.[6] ..... A63B 37/00

[52] U.S. Cl. ..... 273/220; 273/233; 273/232

[58] Field of Search ..... 273/220, 218, 62, 233, 273/234, 235 R, 235 A, 235 B, 232

[56] References Cited

U.S. PATENT DOCUMENTS 3,784,209 1/1974 Berman ..... 273/218
4,141,559 2/1979 Melvin et al. ..... 273/232 X
4,932,664 1/1990 Pocklington et al. ..... 273/232
5,150,906 9/1992 Molitor et al. ..... 273/220
5,273,287 12/1993 Molitor et al. ..... 273/232

FOREIGN PATENT DOCUMENTS 192617 7/1982 New Zealand .

*Primary Examiner*—George J. Marlo
*Attorney, Agent, or Firm*—James P. Ryther

[57] ABSTRACT

A golf ball construction comprising a core, a cover, and an array of dimples formed on the exterior surface of the cover. The ball is characterized by a core diameter between 1.49 and 1.51 inches and by a cover thickness between 0.09 and 0.1 inches. Dimensions within these ranges are selected so that the overall ball diameter is between 1,685 and 1.695 inches, preferably 1.690 inches.

5 Claims, 1 Drawing Sheet

GOLF BALL

BACKGROUND OF THE INVENTION

This invention relates to a golf ball construction which, by virtue of certain carefully selected dimensions, is characterized by improved performance characteristics.

The United States Golf Association has set a variety of rules relative to the game of golf. These include rules governing the equipment that may be used in any golfing event purporting to follow the USGA restrictions.

With respect to golf balls, certain rules govern the ball diameter and weight. Specifically, an official USGA ball must have a diameter of at least 1.680 inches and it must not weigh more than 1.620 ounces. Other specifications govern initial velocity and distance when a golf ball is tested under certain controlled conditions.

With restrictions placed on size and weight, improvements in golf ball performance have focused on the use of new materials for making balls, and on dimple patterns designed to improve characteristics such as accuracy and longer carry. In the former regard, the introduction of two-piece balls consisting of a solid polymeric core and a resin cover material comprising, for example, a Surlyn material manufactured by E. I. du Pont, has constituted a major advance. Such balls have excellent cut resistance and, by utilizing different blends of resins, both distance and "feel" sought by golfers can be achieved.

Dimple patterns have been developed to enhance the flight characteristics of golf balls. In the 1970's, one pattern of choice was the so-called "Atti" design wherein the ball surface was divided into eight generally triangular areas. The resulting dimple pattern comprised 336 dimples which were approximately 0.135 inches in diameter.

By at least the early 1980's, the preference in dimple patterns shifted to an arrangement wherein the dimples are located within a plurality of pentagons, trapezoids, and triangles.

With such patterns, the numbers of dimples increased for example, to 384 or 492 dimples. Thus, without any significant change in dimple size, the surface area coverage by the dimples was increased to 75% or more and this enhanced the golf ball flight characteristics. Pocklington U.S. Pat. No. 4,932,664 is an example of this approach.

Attempts have also been made to use increased size as a basis for improving ball performance. New Zealand Patent No. 192,618 published in 1980 suggested use of ball diameters of 1.7 inches and greater. A Lynx "Jumbo" ball sold at about this same time had a diameter of about 1.8 inches. More recently, as described in U.S. Pat. No. 5,273,287, it is suggested that a ball varying in diameter between 1.7 and 1.8 inches will provide enhanced flight characteristics. It is stated that the ball should be of regulation weight, that is, no greater than 1.62 ounces, and that the increased diameter is achieved by using a core of standard diameter while increasing the cover thickness.

The balls described in U.S. Pat. No. 5,273,287 all include dimple patterns which cover at least 70% of the surface area. This ball, therefore, employs prior-developed icosahedron patterns or the like for improving flight characteristics, or new patterns achieving the same high density of dimples.

SUMMARY OF THE INVENTION

The golf ball of this invention utilizes unique size characteristics for achieving surprisingly suitable performance. In particular, the golf ball includes a core of a specific diameter range and a cover of a specific thickness range to achieve a combination of a unique size. This combination is specifically characterized by improved flight characteristics so that a golfer using the ball can expect straighter shots.

The specific golf ball construction comprises a core diameter between 1.49 and 1.51 inches and a cover thickness between 0.09 and 0.1 inches. Dimensions within these ranges are selected so that the overall ball diameter is between 1.685 and 1.695 inches, preferably 1.690 inches. By utilizing one of the standard, high density dimple patterns such as described in the aforementioned U.S. Pat. No. 4,932,664, a surprisingly effective spin rate, leading to straighter shots, can be achieved.

DESCRIPTION OF PREFERRED EMBODIMENTS

Figure 1:
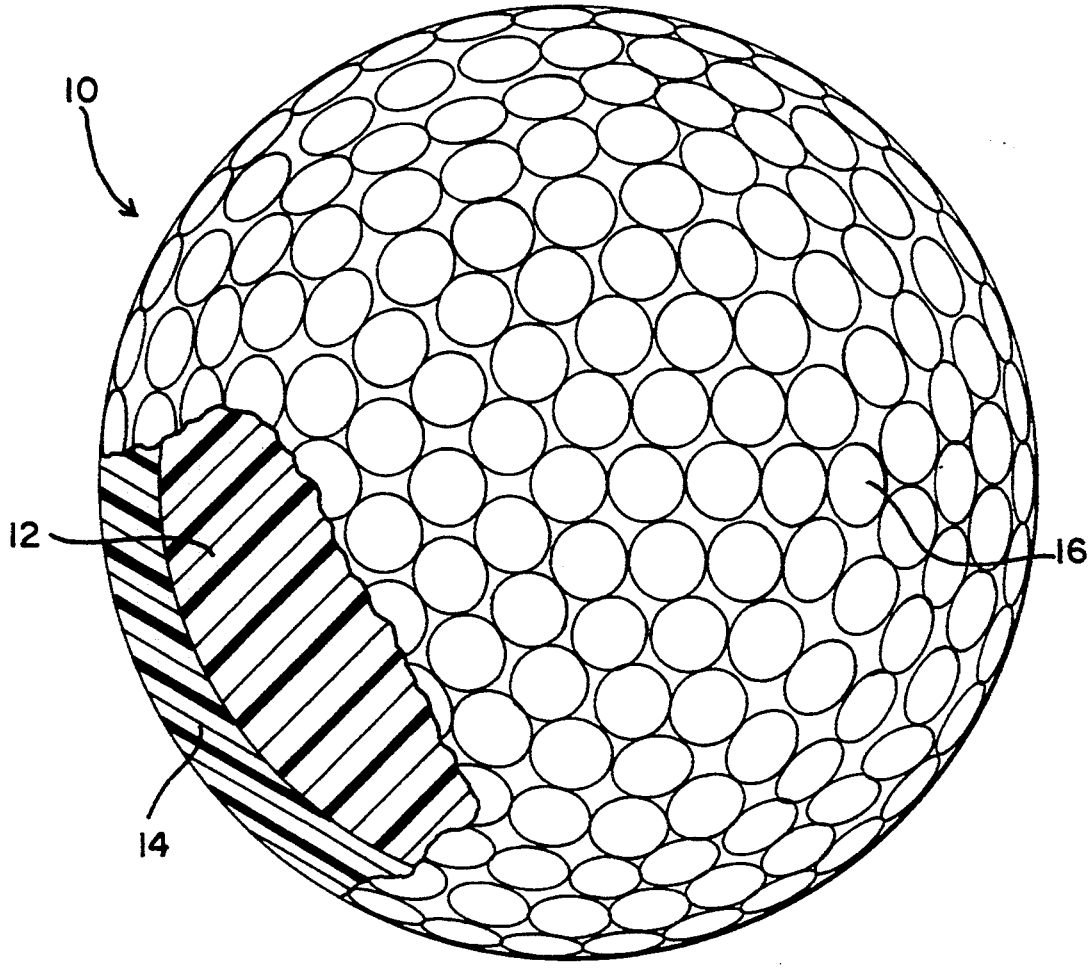
FIG. 1 is an elevational view of a golf ball of the type contemplated by this invention.

The golf ball construction of this invention is preferably of the two-piece type consisting of a solid polymeric core and a "Surlyn" cover or the like. The golf ball 10 shown in FIG. 1 comprises a ball of the type shown in the aforementioned U.S. Pat. No. 4,932,664. This ball includes as core 12 and cover 14, and dimples 16 are formed in the cover surface. It will be understood that the invention is not dependent upon use of any particular materials, and the invention contemplates the use of various core cover materials currently in use, as well as compositions that might be developed in the future.

The dimensions for the ball are tightly controlled. Thus, the core diameter is held between 1.49 and 1.51 inches with a preferred ball having a core diameter of 1.50 inches. This dimension is less than the nominal core dimension of 1.54 inches for a typical ball having a "standard" overall diameter of 1.68 inches. It is also smaller than the nominal diameter of the ball described in U.S. Pat. No. 5,273,387 which is in the order of 1.545 inches.

The preferred golf ball of the invention also has a high density dimple pattern of the type used in the last ten years or more wherein in the order of at least 384 dimples cover 70% or more of ball surface.

The cover thickness of the preferred ball is also tightly controlled between 0.09 and 0.1 inches with 0.095 inches being the preferred dimension. As will be seen, this dimension is significantly greater than the nominal cover thickness for a "standard" ball (0.07 inches), and for a "large size" ball (0.085 inches).

Finally, the ball diameter is controlled between 1.685 and 1.695 inches, preferably 1.690 inches. Thus, dimensions within the ranges for core diameter and cover thickness must be selected to fall within the desired overall diameter range.

A golf ball in accordance with this invention was made with a polymeric core having a diameter of 1.50 inches, a cover thickness of 0.95 inches and an overall diameter of 1.690 inches. The cover was formed of a high modulus blend of zinc and sodium ionomers, for example a blend, by weight, of 40% Surlyn 9220, 10%

Surlyn 7930 and 50% Surlyn 8240. A dimple pattern as described in Pocklington Patent No. 4,932,664 was utilized. The cover hardness was 70 Shore D.

The golf balls of this invention are characterized by a particularly low "spin rate" which results in straighter golf shots. Tests have shown that "standard" balls will spin at about 2300 revolutions per minute when launched by an eleven degree driver travelling at 95 miles per minute. Under the same conditions, the "large size" ball with a minimum nominal diameter of 1.72 inches has a spin rate of 2086 rpm. Surprisingly, a golf ball in accordance with this invention has a spin rate of only 1956 rpm. Thus, there is a decrease in spin rate with a "large" size ball when compared with the standard ball, but applicant has found that an even greater decrease can be found with dimensions controlled as described herein.

It will be appreciated that various changes and modifications may be made in the above-described invention without departing from the spirit thereof particularly as described in the following claims.

What is claimed is:

1. A golf ball construction comprising a core and cover, said core having a diameter of between 1.490 and 1.510 inches, and said cover having a thickness of between 0.090 and 0.10 inches, the golf ball diameter being between 1.685 and 1.695 inches.

2. A golf ball construction according to claim 1 comprising a core having a diameter of 1.500 inches and a cover thickness of 0.095 inches.

3. A golf ball construction according to either of claims 1 or 2 having a weight not in excess of 1.620 ounces.

4. A golf ball construction according to any of claims 1, 2 or 3 having an outer surface, a plurality of dimples formed on said surface, at least 70% of the area of said surface being occupied by said dimples.

5. A golf ball construction according to any of the preceding claims comprising a two-piece ball consisting of the core and cover.

* * * * *